US009512614B2

(12) United States Patent
Klein et al.

(10) Patent No.: US 9,512,614 B2
(45) Date of Patent: Dec. 6, 2016

(54) INSULATING SEALING ELEMENT FOR CONSTRUCTION JOINTS

(71) Applicant: Hilti Aktiengesellschaft, Schaan (LI)

(72) Inventors: Manfred Klein, Kaufering (DE); Christian Foerg, Lamerdingen (DE); Markus Koegler, Buchloe (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 14/803,556

(22) Filed: Jul. 20, 2015

(65) Prior Publication Data

US 2016/0017598 A1 Jan. 21, 2016

Related U.S. Application Data

(60) Provisional application No. 62/026,974, filed on Jul. 21, 2014.

(51) Int. Cl.

| | |
|---|---|
| ***E04C 2/00*** | (2006.01) |
| ***E04B 1/94*** | (2006.01) |
| ***E04B 2/74*** | (2006.01) |

(52) U.S. Cl.

CPC ..... *E04B 1/948* (2013.01); *E04B 2/7411* (2013.01); *E04B 2/7457* (2013.01)

(58) Field of Classification Search

CPC ..... E04B 1/948; E04B 1/82; E04B 1/947; E04B 1/99; E04B 1/946; E04B 2/7411; E04B 2/7457; E04B 2/58; E04B 2002/7481; E04B 1/88; E04B 1/66; E04B 2001/829; E04B 1/8209; E04B 2/7409; A62C 2/65; F16J 15/00; F16J 15/02; F16J 15/022; F16J 15/104

USPC ..... 52/232, 317

See application file for complete search history.

(56) References Cited

U.S. PATENT DOCUMENTS

| | | | | |
|---|---|---|---|---|
| 3,206,216 A * | 9/1965 | Crook | F16J 15/062 210/450 |
| 3,865,386 A * | 2/1975 | Wilke | F16J 15/022 251/900 |
| 4,805,364 A | 2/1989 | Smolik | |
| 4,854,096 A | 8/1989 | Smolik | |
| 5,010,702 A | 4/1991 | Daw et al. | |
| 5,127,203 A | 7/1992 | Paquette | |
| 5,127,760 A | 7/1992 | Brady | |
| 5,471,805 A | 12/1995 | Becker | |
| 5,755,066 A | 5/1998 | Becker | |
| 5,913,788 A | 6/1999 | Herren | |

(Continued)

FOREIGN PATENT DOCUMENTS

CA 2 550 201 A1 12/2007

OTHER PUBLICATIONS

U.S. Patent Application, "Intumescent Sealing Element for Head-of-Wall Joints", U.S. Appl. No. 14/673,093, filed Mar. 30, 2015, Inventor: Manfred Klein et al.

(Continued)

*Primary Examiner* — Brian Mattei

(74) *Attorney, Agent, or Firm* — Crowell & Moring LLP

(57) ABSTRACT

A sealing element for sealing a gap or joint between a support structure and a track is disclosed. The track includes a web and legs that extend vertically from the web. The sealing element includes a cover layer and an insulating strip disposed on the cover layer. The insulating strip includes a portion with a round, an oval, or a triangular cross-section.

20 Claims, 4 Drawing Sheets

(56) References Cited

U.S. PATENT DOCUMENTS

| | | | | |
|---|---|---|---|---|
| 5,921,041 | A | 7/1999 | Egri, II | |
| 5,950,385 | A | 9/1999 | Herren | |
| 5,968,615 | A * | 10/1999 | Schlappa | E04B 1/948 428/192 |
| 6,058,668 | A | 5/2000 | Herren | |
| 6,131,352 | A * | 10/2000 | Barnes | E04B 1/948 52/396.01 |
| 6,176,053 | B1 | 1/2001 | St. Germain | |
| 6,698,146 | B2 | 3/2004 | Morgan et al. | |
| 6,748,705 | B2 | 6/2004 | Orszulak et al. | |
| 6,783,345 | B2 | 8/2004 | Morgan et al. | |
| 6,948,287 | B2 * | 9/2005 | Korn | E04B 1/68 277/510 |
| 7,043,880 | B2 | 5/2006 | Morgan et al. | |
| 7,152,385 | B2 | 12/2006 | Morgan et al. | |
| 7,240,905 | B1 | 7/2007 | Stahl, Sr. | |
| 7,617,643 | B2 | 11/2009 | Pilz et al. | |
| 7,681,365 | B2 | 3/2010 | Klein | |
| 7,752,817 | B2 | 7/2010 | Pilz et al. | |
| 7,814,718 | B2 | 10/2010 | Klein | |
| 7,866,108 | B2 | 1/2011 | Klein | |
| 7,950,198 | B2 | 5/2011 | Pilz et al. | |
| 8,056,293 | B2 | 11/2011 | Klein | |
| 8,087,205 | B2 | 1/2012 | Pilz et al. | |
| 8,132,376 | B2 | 3/2012 | Pilz et al. | |
| 8,136,314 | B2 | 3/2012 | Klein | |
| 8,151,526 | B2 | 4/2012 | Klein | |
| 8,181,404 | B2 | 5/2012 | Klein | |
| 8,281,552 | B2 | 10/2012 | Pilz et al. | |
| 8,322,094 | B2 | 12/2012 | Pilz et al. | |
| 8,353,139 | B2 | 1/2013 | Pilz et al. | |
| 8,375,666 | B2 * | 2/2013 | Stahl, Jr. | E04B 1/948 52/232 |
| 8,413,394 | B2 | 4/2013 | Pilz et al. | |
| 8,468,759 | B2 | 6/2013 | Klein | |
| 8,499,512 | B2 | 8/2013 | Pilz et al. | |
| 8,555,566 | B2 | 10/2013 | Pilz et al. | |
| 2005/0032934 | A1 | 2/2005 | Muenzenberger et al. | |
| 2006/0137293 | A1 | 6/2006 | Klein | |
| 2010/0199583 | A1 * | 8/2010 | Behrens | E04B 1/948 52/396.01 |
| 2011/0099928 | A1 | 5/2011 | Klein et al. | |
| 2011/0113709 | A1 * | 5/2011 | Pilz | E04B 1/948 52/232 |
| 2011/0146180 | A1 | 6/2011 | Klein | |
| 2011/0167742 | A1 | 7/2011 | Klein | |
| 2011/0214371 | A1 | 9/2011 | Klein | |
| 2011/0247281 | A1 | 10/2011 | Pilz et al. | |
| 2012/0297710 | A1 | 11/2012 | Klein | |
| 2013/0031856 | A1 | 2/2013 | Pilz et al. | |
| 2013/0086859 | A1 | 4/2013 | Pilz et al. | |
| 2013/0091790 | A1 | 4/2013 | Stahl, Jr. et al. | |
| 2013/0118102 | A1 | 5/2013 | Pilz et al. | |
| 2013/0186020 | A1 | 7/2013 | Pilz | |
| 2013/0205694 | A1 | 8/2013 | Stahl, Jr. | |
| 2015/0135622 | A1 * | 5/2015 | Muenzenberger | E04B 1/948 52/407.1 |
| 2016/0115813 | A1 * | 4/2016 | Davis | F01D 11/005 277/592 |

OTHER PUBLICATIONS

U.S. Patent Application, "Insulating Sealing Element for Head-of-Wall Joints", U.S. Appl. No. 14/673,117, filed Mar. 30, 2015, Inventor: Manfred Klein et al.

U.S. Patent Application, "Insulating Sealing Element for Head-of-Wall Joints", U.S. Appl. No. 14/673,148, filed Mar. 30, 2015, Inventor: Manfred Klein et al.

U.S. Patent Application, "Insulating Sealing Element for Head-of-Wall Joints", U.S. Appl. No. 14/543,523, filed Nov. 17, 2014, Inventor: Herbert Muenzenberger et al.

U.S. Patent Application, "Insulating Sealing Element for Head-of-Wall Joints", U.S. Appl. No. 14/543,539, filed Nov. 17, 2014, Inventor: Christian Foerg et al.

U.S. Patent Application, "Insulating Sealing Element for Head-of-Wall Joints", U.S. Appl. No. TBD, filed Jul. 20, 2015, Inventor: Manfred Klein et al.

* cited by examiner

INSULATING SEALING ELEMENT FOR CONSTRUCTION JOINTS

This application claims the benefit of U.S. Provisional Application No. 62/026,974, filed Jul. 21, 2014, the disclosure of which is expressly incorporated by reference herein.

BACKGROUND AND SUMMARY OF THE INVENTION

The present invention deals generally with the field of acoustical or firestopping insulation for construction joints, including, possibly, intumescent components.

In the building construction trade, a head-of-wall joint/gap (also sometimes referred to as a top-of-wall joint/gap) refers to the linear junction or interface existing between a top section of a framing or wallboard wall assembly and the ceiling, where the ceiling may be a next-level floor or corrugated/fluted pan roof deck, for example. A head-of-wall assembly is comprised of and defined by the following elements overhead structure, top of wall framing deflection system, fill, void, or cavity materials protecting any joints. Corrugated/fluted deck includes either floor or roof pan deck assemblies varying in flute size, height, and configuration. Concrete decks include post-tensioned slabs, poured in place concrete, and precast concrete units. Gypsum drywall ceilings are common fire rated assemblies.

Head-of-wall joints often present a serious challenge in terms of reducing or preventing the spread of smoke and fire during a building fire. In this regard and in common practice, a wall to ceiling connection of many newly constructed buildings consists essentially of metal framing assemblies. These metal framing assemblies are generally constructed from a plurality of metal framing members including studs, joints, trusses, and other metal posts and beams formed from sheet metal and frequently fabricated to have the same general cross-sectional dimensions as standard members used for similar purposes. Typical head-of-wall deflection systems include the following: "single long leg track", which is n U-shaped track having typically longer legs, typically free floating studs, some type of bracing (CRC, flatstrap) to prevent rotation of studs; "double track", which is a nested track configured of two U-shaped profiles, designed for screw attachment to brace studs without need for other bracing materials; "slotted track", which is n U-shaped track having vertical slots located in the legs allowing for faster attachment through the slots, whereas screws keep the studs in place; and "slotted clips", which are U-shaped tracks having pre-installed slotted clips that allow for attachment of fasteners through the slots, another way to attach the studs to eliminate dislodging. Although many cross-sectional shapes are available, the primary shapes used in building construction are C-shaped studs and U-shaped tracks. These C-shaped studs and U-Shaped studs may vary in their size, which, however, are standardized. The steel track (or channel) is configured to receive steel studs between the legs of the shaped channel. A wallboard is generally attached to at least one side of the studs. The studs and wallboard are in many instances spaced apart from the ceiling with a short gap distance in order to allow for ceiling deflections caused by seismic activity or moving overhead loads. Track and stud assemblies that allow for ceiling deflections are commonly referred to as dynamic head-of-wall systems. Exemplary steel stud wall constructions may be found in U.S. Pat. Nos. 4,854,096 and 4,805,364 both to Smolik, and U.S. Pat. No. 5,127,203 to Paquette. Exemplary dynamic head-of-wall systems having steel stud wall constructions may be found in U.S. Pat. No. 5,127,760 to Brady and U.S. Pat. No. 6,748,705 to Orszulak et al.

Firestops are thermal barrier materials or combinations of materials used for filling gaps and openings such as in the joints between fire-rated walls and/or floors of buildings. For example, firestops can be used in walls or floors to prevent fire and smoke from passing through the gaps or openings required for cables, pipes, ducts, or other conduits. Firestops are also used to fill joint gaps that occur between walls, between a ceiling and the head-of-wall joints.

So-called head-of-wall joints pose a number of challenges for the fireproofing industry. Walls are increasingly being made of gypsum wallboard affixed to a framework of metal studs capped by a horizontally extending track. Ceilings are increasingly being made by pouring concrete onto fluted steel. Although the distance between the horizontally extending tracks at the top of the wall is often fixed in relationship to the ceiling, the gypsum wallboards are subject to expansion and contraction due to motion of other building components, ground settling, or other causes. The joint, based on amount of deflection required, is designed and constructed to allow for vertical movement, allowing the wall to move independent of the structure, due to forces such as live/dead loading, thermal expansion/contraction, wind sway, or seismic movements. The head-of-wall joints allow vertical movement without damaging the wall or drywall. The drywall is the fire protection component and it's key that it's not damaged/cracked.

In order to contain the spread of smoke and fire, a fire resistant material such as, for example, mineral wool is often times stuffed into the gaps between the ceiling and wallboard (see, e.g., U.S. Pat. No. 5,913,788 to Herren). For example, mineral wool is often stuffed between a steel header track (e.g., an elongated U-shaped channel) and a corrugated steel roof deck (used in many types of steel and concrete building constructions); a fire resistant and generally elastomeric spray coating is then applied onto the exposed mineral wool to thereby form a fire resistant joint seal (see, e.g., U.S. Pat. No. 7,240,905 to Stahl). In certain situations where the ceiling to wallboard gap is relatively small, a fire resistant and elastomeric caulk is commonly applied so as to fill any small gaps. In still another approach and as disclosed in U.S. Pat. Nos. 5,471,805 and 5,755,066 both to Becker, a slidable non-combustible secondary wall member is fastened to an especially configured steel header track and immediately adjacent to the wallboard. In this configuration, the secondary wall member provides a fire barrier that is able to accommodate ceiling deflections. All of these approaches, however, are relatively labor intensive and thus expensive.

Intumescent materials have long been used to seal certain types of construction gaps such as, for example, conduit through-holes. In this regard, intumescent and fire barrier materials (often referred to as firestop materials or fire retardant materials) have been used to reduce or eliminate the passage of smoke and fire through openings between walls and floors and the openings caused by through-penetrations (i.e., an opening in a floor or wall which passes all the way through from one room to another) in buildings, such as the voids left by burning or melting cable insulation caused by a fire in a modern office building. Characteristics of fire barrier materials suitable for typical commercial fire protection use include flexibility prior to exposure to heat, the ability to insulate and/or expand, and the ability to harden in place upon exposure to fire (i.e., to char sufficiently to deter the passage of heat, smoke, flames, and/or gases). Although many such materials are available, the industry has long sought better and more effective uses of these materials and novel approaches for better fire protection, especially in the context of dynamic head-of-wall construction joints and gaps. The materials have the drawback that they are expensive.

Thus, and although construction joints and gaps are generally sealed in some manner (e.g., mineral wool and/or elastomeric coatings; see also, U.S. Patent Application No. 2006/0137293 to Klein), there are relatively few products and methods available that effectively and efficiently seal head-of-wall construction joints and gaps to thereby significantly enhance the ability of such joints and gaps to withstand smoke and fire penetration. In particular, there are very few products and methods available that address the needs for adequate fire protection and sealing of dynamic head-of-wall systems associated with steel stud wall constructions.

Recently more advanced head-of-wall fire block arrangements have been developed based on fire block header tracks. These fire block header tracks utilize an expandable fire-resistant material, such as an intumescent material, applied along a length of the header track of a wall assembly. The intumescent material is either positioned on the web of the header track, on the legs (hereinafter also referred to as flange) of the header track or alternatively wraps around a corner of the header track, extending both along a portion of a web of the header track and a flange of the header track. The intumescent material advantageously is held in place between the web of the header track and the floor or ceiling above the wall. When exposed to a sufficient temperature, the intumescent material expands to fill gaps at the head-of-wall. The portion of the intumescent trapped between the header track and the floor or ceiling ensures that the intumescent stays in place as it expands and does not become dislodged as a result of the expansion.

With the use of such fire-resistant material, the metal tracks often require a unique construction on the exterior surface of the metal track which can have a predefined area such as a recess or the like which identifies the specific location required for placement of such an intumescent and/or acoustic layer of insulation material. In particular, as the joint moves responsive to normal expansion and contraction of the building components, the insulating tape and/or the coatings of insulating material which is attached directly to the surfaces of flanges can become dislodged from components of the head-of-wall area, that is, particularly dislodging from the surfaces of the downwardly extending side sections of the track or runner. Also these systems do not specifically address variations in the contour or profile of the ceiling or roof area which comes into direct abutment with the upper portion of the metal track. Such variations in the configuration of the building construction in this area can form gaps between the track and the adjacent roof or ceiling area which are not adequately addressed for insulation by the above described prior art systems.

It is an object of the sealing strip for sealing construction joints of the present invention to effectively seal joints between conventionally designed metal track sections and the immediately adjacent roof or ceiling area for firestopping and optionally acoustic insulating thereof.

It is an object of the sealing strip for sealing construction joints of the present invention to be usable with any joints and gaps between construction elements, preferably conventional steel framing and gypsum board wall constructions.

It is an object of the sealing strip for sealing construction joints of the present invention to be usable with floor or roof constructions of any conventional construction including solid concrete or a composite material installed atop a corrugated steel deck.

It is an object of the sealing strip for sealing construction joints of the present invention to prevent the spread of sound, noise, fire, super-heated gases, flames and/or smoke in these areas.

It is an object of the sealing strip for sealing construction joints of the present invention to provide more effective insulating by providing the insulating material just before the joint between the top of the metal track and the bottom of the support structure, e.g., overhead structure in case of a ceiling, to assure sealing against cold gases and smoke before the material provides a firestop at elevated temperatures.

It is an object of the sealing strip for sealing construction joints of the present invention to minimize costs and maintenance requirements.

It is an object of the sealing strip for sealing construction joints of the present invention to expedite installation and minimize labor costs.

One of the advantages of the sealing strip of the present invention is that it is usable with conventionally OEM metal track construction and does not require any customized design for the ceiling runner.

Another advantage of the sealing strip of the present invention is that for providing a fire rated sealing no intumescent material is needed since the sealing strip permanently covers the critical joints. It is nevertheless possible to also integrate an intumescent material.

Another advantage of the sealing strip of the present invention is that contrary to sealing masses which are applied on site the amount of insulating material needed is fixed.

Another advantage of the sealing strip of the present invention is that the material costs are very low and due to its specific design the strip is very easy to apply and can be placed in position.

Many patents have been applied or granted for various constructions for insulating head-of-wall joints as described above such as shown in U.S. Patent Application Publication No. 2011/247281 A1 published Oct. 13, 2011 to Don A. Pilz et al. assigned to California Expanded Metal Products Company on a "FIRE-RATED WALL CONSTRUCTION PRODUCT"; U.S. Patent Application Publication No. 2013/031856 A1 published Feb. 7, 2013 to Don A. Pilz et al. assigned to California Expanded Metal Products Company on a "FIRE-RATED WALL CONSTRUCTION PRODUCT"; U.S. Pat. No. 8,281,552 B2 patented Oct. 9, 2012 to Don A. Pilz et al. assigned to California Expanded Metal Products Company on a "EXTERIOR WALL CONSTRUCTION PRODUCT"; U.S. Pat. No. 8,499,512 B2 patented Aug. 6, 2013 to Don A. Pilz et al. assigned to California Expanded Metal Products Company on a "EXTERIOR WALL CONSTRUCTION PRODUCT"; U.S. Patent Application Publication No. 2013/0086859 A1 published Apr. 11, 2013 to Donald A. Pilz et al. assigned to California Expanded Metal Products Company on a "FIRE-RATED WALL AND CEILING SYSTEM"; U.S. Pat. No. 7,617,643 B2 patented Nov. 17, 2009 to Donald A. Pilz et al. assigned to California Expanded Metal Products Company on a "FIRE-RATED WALL AND CEILING SYSTEM"; U.S. Pat. No. 7,950,198 B2 patented May 31, 2011 to Donald A. Pilz et al. assigned to California Expanded Metal Products Company on a "FIRE-RATED WALL AND CEILING SYSTEM"; U.S. Pat. No. 8,087,205 B2 patented Jan. 3, 2012 to Don A. Pilz et al. assigned to California Expanded Metal Products Company on a "FIRE-RATED WALL AND CEILING SYSTEM"; U.S. Pat. No. 8,322,094 B2 patented Dec. 4, 2012 to Don A. Pilz et al. assigned to California Expanded Metal Products Company on a "FIRE-RATED WALL AND CEILING SYSTEM"; U.S. Pat. No. 7,752,817 B2 patented Jul. 13, 2010 to Don A. Pilz et al. assigned to California Expanded Metal Products Company on a "TWO-PIECE TRACK SYSTEM"; U.S. Pat. No. 8,132,376 B2 patented Mar. 13, 2012 to Don A. Pilz et al. assigned to California Expanded Metal Products Company on a "TWO-PIECE TRACK SYSTEM"; U.S. Pat. No. 8,413,394 B2 patented Apr. 9, 2013 to Don A. Pilz et al. assigned to California Expanded Metal Products Company on a "TWO-PIECE TRACK SYSTEM"; U.S. Pat. No. 8,555,566 B2 patented Oct. 15, 2013 to Don A. Pilz et al. assigned to California Expanded Metal Products Company on a "TWO-PIECE TRACK SYSTEM"; U.S. Patent Application Publication No. 2011/214371 A1 published Sep. 8, 2011 to James A. Klein assigned to Blazeframe Ind. Ltd. on an "OFFSET LEG FRAMING ELEMENT FOR FIRE STOP APPLICATIONS"; U.S. Pat. No. 8,468,759 B1 patented Jun. 25, 2013 to James A. Klein assigned to Blazeframe Ind. Ltd. on an "FIRE RETARDANT COVER FOR FLUTED ROOF DECK"; U.S. Patent Application Publication No. 2011/146180 A1 published Jun. 23, 2011 to James A. Klein assigned to Blazeframe Ind. Ltd. on an "ACOUSTICAL AND FIRESTOP RATED TRACK FOR WALL ASSEMBLIES HAVING RESILIENT CHANNEL MEMBERS"; U.S. Patent Application Publication No. 2011/167742 A1 published Jul. 14, 2011 to James A. Klein assigned to Blazeframe Ind. Ltd. on "HEAD-OF-WALL FIREBLOCK SYSTEMS AND RELATED WALL ASSEMBLIES"; U.S. Pat. No. 7,681,365 B2 patented Mar. 23, 2010 to James A. Klein on "HEAD-OF-WALL FIREBLOCK SYSTEMS AND RELATED WALL ASSEMBLIES"; U.S. Pat. No. 7,814,718 B2 patented Oct. 19, 2010 to James A. Klein on "HEAD-OF-WALL FIREBLOCKS"; U.S. Pat. No. 7,866,108 B2 patented Jan. 11, 2011 to James A. Klein on "HEAD-OF-WALL FIREBLOCK SYSTEMS AND RELATED WALL ASSEMBLIES"; U.S. Pat. No. 8,056,293 B2 patented Nov. 15, 2011 to James A. Klein on "HEAD-OF-WALL FIREBLOCK SYSTEMS AND RELATED WALL ASSEMBLIES"; U.S. Pat. No. 8,136,314 B2 patented Mar. 20, 2012 to James A. Klein on "HEAD-OF-WALL FIREBLOCKS"; U.S. Pat. No. 8,151,526 B2 patented Apr. 10, 2012 to James A. Klein on "HEAD-OF-WALL FIREBLOCK SYSTEMS AND RELATED WALL ASSEMBLIES"; U.S. Patent Application Publication No. 2012/0297710 A1 published Nov. 29, 2012 to James A. Klein on "CONTROL JOINT BACKER AND SUPPORT MEMBER ASSOCIATED WITH STRUCTURAL ASSEMBLIES"; U.S. Patent Application Publication No. 2011/0099928 A1 published May 5, 2011 to James A. Klein and Alastair Malcolm on "DEFELCTION AND DRIFT STRUCTURAL WALL ASSEMBLIES"; CA Patent Application Publication No. 2550201 A1 published Dec. 15, 2007 to James A. Klein on "HEAD-OF-WALL FIREBLOCKS AND RELATED WALL ASSEMBLIES"; U.S. Pat. No. 8,181,404 B2 patented May 22, 2012 to James A. Klein on "HEAD-OF-WALL FIREBLOCKS AND RELATED WALL ASSEMBLIES"; U.S. Patent Application Publication No. 2013/0186020 A1 published Jul. 25, 2013 to Don A. Pilz assigned to California Expanded Metal Products Company on a "FIRE-RATED JOINT SYSTEM"; U.S. Pat. No. 8,353,139 B2 patented Jan. 15, 2013 to Don A. Pilz et al. assigned to California Expanded Metal Products Company on a "WALL GAP FIRE BLOCK DEVICE, SYSTEM AND METHOD"; U.S. Patent Application Publication No. 2013/118102 A1 published May 19, 2011 to Don A. Pilz et al. assigned to California Expanded Metal Products Company on a "WALL GAP FIRE BLOCK DEVICE; SYSTEM AND METHOD"; U.S. Patent Application Publication No. 2013/205694 A1 published Aug. 15, 2013 to James P. Stahl assigned to Specified Technologies Inc. on "INSULATING GASKET CONSTRUCTION FOR HEAD-OF-WALL JOINTS"; U.S. Pat. No. 8,375,666 B2 patented Feb. 19, 2013 to James P. Stahl et al assigned to Specified Technologies Inc. on "FIRESTOPPING SEALING MEANS FOR USE WITH GYPSUM WALLBOARD IN HEAD-OF-WALL CONSTRUCTION"; U.S. Patent Application Publication No. 2013/091790 A1 published Apr. 18, 2013 to James P. Stahl et al. assigned to Specified Technologies Inc. on "FIRESTOPPING MEANS FOR USE WITH GYPSUM WALLBOARD IN HEAD-OF-WALL CONSTRUCTION"; U.S. Pat. No. 7,240,905 B2 patented Jul. 10, 2007 to James P. Stahl on "METHOD AND APPARATUS FOR SEALING A JOINT GAP BETWEEN TWO INDEPENDENTLY MOVABLE STRUCTURAL SUBSTRATES"; U.S. Pat. No. 6,698,146 B2 patented Mar. 2, 2004 to Michael D. Morgan et al. assigned to W.R. Grace & Co.-Conn. on "IN SITU MOLDED THERMAL BARRIERS"; U.S. Pat. No. 6,783,345 B2 patented Aug. 31, 2004 to Michael D. Morgan et al. assigned to W.R. Grace & Co.-Conn. on "IN SITU MOLDED THERMAL BARRIERS"; U.S. Pat. No. 7,043,880 B2 patented May 16, 2006 to Michael D. Morgan et al. assigned to W.R. Grace & Co.-Conn. on "IN SITU MOLDED THERMAL BARRIERS"; U.S. Pat. No. 7,152,385 B2 patented Dec. 26, 2006 to Michael D. Morgan et al. assigned to W.R. Grace & Co.-Conn. on "IN SITU MOLDED THERMAL BARRIERS"; U.S. Pat. No. 5,010,702 patented Apr. 30, 1991 to T. L. Daw et al and assigned to Daw Technologies, Inc. on a "Modular Wall System"; and U.S. Pat. No. 5,127,203 patented Jul. 7, 1992 to R. F. Paquette on a "Seismic/Fire Resistant Wall Structure and Method"; and U.S. Pat. No. 5,755,066 patented May 26, 1998 to D. W. Becker on a "Slip Track Assembly; and U.S. Pat. No. 5,913,788 patented Jun. 22, 1999 to T. R. Herren on a "Fire Blocking And Seismic Resistant Wall Structure"; and U.S. Pat. No. 5,921,041 patented Jul. 13, 1999 to J. D. Egri, II on a "Bottom Track For Wall Assembly"; and U.S. Pat. No. 5,950,385 patented Sep. 14, 1999 to T. R. Herren on an "Interior Shaft Wall Construction"; and U.S. Pat. No. 6,058,668 patented May 9, 2000 to T. R. Herren on a "Seismic And Fire-Resistant Head-of-Wall Structure"; and U.S. Pat. No. 6,176,053 patented Jan. 23, 2001 to Roger C. A. St. Germain and assigned to Robert C. A. St. Germain on a "Wall Track Assembly And Method For Installing The Same".

Although the known fire block header tracks provide exceptional performance, there still exists a need for fire block arrangements that can be applied to any desired structure showing gaps and joints, such as the wall, floor or ceiling of a building construction or to the stud wall assembly and to header tracks. In general the sealing strip of the present invention can be applied to any structure where two structural elements/components contact each other and form joints. Furthermore, as described herein, alternative embodiments of the sealing strip according to invention can be applied to a wall bottom track to protect a foot-of-wall gap or a (vertical or horizontal) gap in a location other than the head or foot of a wall. The present fire blocks are well-suited to application on the job site.

The sealing strip of the present invention can be applied to any joint or gap between construction elements of any kind, e.g., wall to wall joints, wall to floor joints, wall to ceiling joints, joints between construction elements such as floor, wall, or ceiling, which are also referred to as support structure, and construction elements other than the support structures such as dry wall assemblies, in particular to the tracks, i.e., bottom and header track. For a better understanding, the invention will be described in view of the joint between an element of a dry wall assembly, e.g., the track, in particular header track, and a support structure, e.g., the ceiling, to which the track is fixed. This however shall not be understood to limit the scope of the invention.

In brief, the present invention is directed in general to a fire retardant head-of-wall assembly configured to seal a linear construction joint or gap when exposed to a heat source, such as in the event of fire. In more detail the present invention is directed to sealing means, in particular firestopping sealing means, for use with dry wallboard, i.e., gypsum wallboard, in a head-of-wall or similar construction. The sealing strip being positioned in the corner between the track and the ceiling and thus covers the joint, i.e., is positioned directly on the joint. The sealing strip provides the sealing of the joint to prevent sound, hot gases, smoke and/or fire to pass the joint.

According to the present invention the sealing strip is a band-shaped strip, preferably designed as an endless strip thus enabling its production as a roll. The sealing strip comprises an insulating material and a cover or support material. According to preferred embodiments the sealing strip is designed as a tape that comprises a cover or support material strip, preferably in form of a tape, and an insulating material portion applied to one surface of the cover strip or support strip in form of a strip. Herein, the cover or support material strip or tape is briefly referred to as cover layer and the insulating material portion is briefly referred to as insulating strip. The cover layer includes side portions that extend beyond the insulating strip, i.e., the width of the cover layer is larger than the width of the insulating strip.

In one embodiment the insulating strip provides the sealing of the joint or gap to prevent sound, hot gases, smoke and/or fire to pass the joint. The cover layer provides the support for the insulating strip and mechanical strength to the sealing strip and simplifies the application of the sealing strip, e.g., by avoiding direct contact with the insulating strip. In another embodiment the cover layer provides sealing against smoke and/or fire. In this embodiment the insulating strip may additionally provide sound and acoustic sealing. Furthermore, the cover layer prevents the sealing strip from sticking or adhering to any other construction element such as a wallboard so that the sealing strip will not be torn down or removed from the joint when the wall moves up and down due to its deflection. This assures reliable sealing of the joint.

The insulating material preferably is self-adhesive to fix the sealing strip on the construction element so that no further adhesive is needed. It is also preferred that the insulating material is easily formable or workable thus enabling an easier application and a best possible adaption of the sealing strip to the structure of the joint and its surroundings. After installation of the sealing strip most of the material of the insulating strip is positioned before the joint. Another advantage of the insulating material being formable, preferably permanent formable, is that after installation of the sealing strip movement of the adjacent structural elements won't be hindered. If the wallboard moves upwards or the ceiling moves downwards the wallboard is pushed in the corner between the ceiling and the track and the wallboard squeezes the insulating strip which will be flattened but will maintain its position before the joint. This on the one hand ensures free movement of the wallboard and on the other hand ensures a reliable sealing of the joint.

The insulating material is not limited and will be selected according to the intended properties of the sealing strip, i.e., sealing against sound, hot gases, smoke and/or fire. It may provide additional properties such as fire protection or sound and acoustic insulation or both. Thus, the additional insulating element may comprise non-intumescent and/or intumescent materials whereas a material is preferred that can easily be provided with intumescent properties. An intumescent material will be used if enhanced sealing in the event of fire is intended. The intumescent material therefore may be constructed partially or entirely from an intumescent material. It is also possible for the insulating material of the present invention to have components of both intumescent and acoustical sealing therewithin. When the temperature rises the intumescent material will expand quickly and block air pathways.

An acoustical insulating material is intended for applications where sealing against sound transmissions is found to be desirable. Such acoustical insulating configurations can preferably be formed of a compressible material such as plasticines. Plasticines, which are also referred to as putties, are frequently used for this application. They generally consist of a liquid polymer such as butyl rubber, plasticizers (paraffin oil, phthalates, adipates, etc.) and fillers, with a filler content of up to 80 percent. In particular the plasticine contains, as liquid polymer, at least one representative of the group comprising polyurethanes, polyvinyl acetates, polyvinyl ethers, polyvinyl propionates, polystyrenes, natural or synthetic rubbers, poly((meth)acrylates) and homopolymers and copolymers based on (meth)acrylates, acrylonitrile, vinyl esters, vinyl ethers, vinyl chloride and/or styrene, preferably poly(alkyl methacrylate), poly(alkyl acrylate), poly(aryl methacrylate), poly(aryl acrylate) and/or copolymers thereof with n-butyl acrylate and/or styrene. The plasticine may comprise fire-protection additives. In this regard reference is made to the U.S. patent application No. 2005/032934 A1 which is incorporated in its entirety herein by reference.

The advantage of using a formable, self-adhesive material such as putties is that it provides sufficient adhesive strength to many structural materials, that it provides sufficient sound insulation and can very easily be adapted to provide intumescent properties.

In case the insulating material of the insulating strip provides sufficient fire protection or in case fire protection will not be necessary, then the cover layer itself must not provide fire protection. In this case the material of the cover layer is not limited provided that is provides sufficient mechanical strength to the sealing strip. In such embodiments the cover layer can be a film material, preferably a synthetic film like plastic or poly-type material such as polyalkylene material, for example polyethylene material. In one embodiment the cover layer has a printable surface. A positioning aid can be provided by including a mark in the form of an optionally colored line on the cover layer which helps to affix the insulating strip on the header track in an ideal position.

In case the insulating material of the insulating strip does not provide any fire protection then the cover material layer shall provide fire resistant means to sufficiently seal the joint against fire to prevent the penetration of fire and in some embodiments also of smoke for a given period of time. In this case the cover layer is made of non-combustible, i.e., fire resistant, material. The cover layer can be made of a fabric, which fabric comprises inorganic fibers such as fibers made of glass, stone, ceramic and/or metal or any other suitable material, in particular glass fibers. Alternatively, the cover layer can be an inorganic film material, like metal films or any other suitable film material, in particular metal films, e.g., aluminum foil having a thickness of about 20 to 50 microns (20-50 μm). It is also possible that the cover layer comprises a combination of inorganic fibers and an inorganic film material, e.g., a layer made of inorganic fibers such as glass fibers, and a further layer (coat layer) made of an inorganic film material such as an aluminum foil.

The cover layer provides protection in the event that the construction element to which the sealing strip shall be applied is designed to accommodate movement, which could for example result in a wallboard contacting or rubbing against the insulating material when moving up and down due to movement of the building. When the insulating strip is made of a formable material, the insulating strip will deform when it is applied to the joint. In some cases the insulating strip will be squeezed out of the area of the joint. With this the insulating strip is getting broader. Then the side portions of the cover or support layer still will cover the squeezed insulating strip to avoid unintentional contact with other parts of the construction assembly.

It is also possible that the cover layer comprises a combination of a fabric and an inorganic film material or synthetic film material, e.g., a layer made of inorganic fibers such as glass fibers, and a further layer (coat layer) made of an inorganic film material such as an aluminum foil or made of an synthetic film material such as a polyalkylene film.

To enhance the inherent (dimensional) stability and to increase the mechanical strength of the cover layer, the fabric may contain weft thin metal wires. The cover layer preferably is abrasive-resistant to resist abrasion caused by the gypsum wall member of the dry wall assembly rubbing against the sealing strip when moving up and down due to movement of the building. The optional weft metal wires enhance the abrasive-resistant properties.

In one embodiment, in particular when the insulating strip is made of a self-adhesive material, the insulating strip is covered with an additional detachable release layer, e.g., a thin synthetic film material to avoid sticking of the insulating strip on the support layer, when rolled up and prevent tearing of the insulating strip.

In a preferred embodiment the cover layer is coated with a thin layer of a material that has less adhesion to the insulating material than the cover layer, such as a thin silicon coating, to avoid sticking of the insulating material strips on the cover layer when rolled up and prevent tearing off the insulating material strips.

According to one (first) aspect of the invention the insulating strip will be prefabricated to have a specific cross-section, e.g., round, oval or triangular, to enable an easy application of the sealing strip in the corner between the track and the ceiling and to better adapt the sealing strip to the structure (dimension) of the corner.

Preferably the insulating strip is applied to the center of the cover layer so that the cross-section of the sealing strip gives a symmetrical body, thus enabling the user to unroll the sealing strip from either the left or the right. This assures a very easy installation no matter from which side the sealing element will be installed. In this embodiment the sealing strip will only cover the very upper part of the leg of the track. The main part of the leg is free of any insulating material.

According to another (second) aspect of the invention the insulating strip comprises a cover layer and an insulating strip, whereas the insulating strip comprises two portions with different cross-sections.

According to this aspect the sealing strip is designed to better seal hems (joint edges), in particular where the front edges of the legs of the two tracks contact each other when two tracks are installed in a row to extend the track. This also helps to better install a further sealing strip just after the first one and to avoid gaps between the sealing strips.

This can be achieved by an insulation strip having an additional insulating portion, which preferably is thin and band-shaped. The cover layer covers the insulating strip comprising the two insulating portions. Also in this embodiment the cover layer has side sections which extend beyond the insulating strip. The insulating portions, i.e., the strip portion having a round, oval or triangular shape and the strip portion having a rectangular shape, can integrally be formed of the same material to form a single strip. As an alternative two insulating strips with different cross-sections, i.e., one with round, oval or triangular cross-section and one with a flat rectangular cross-section, can be applied on the cover layer next to each other in two working steps.

With this embodiment the hems between two tracks and the joint between the track and the ceiling can be sealed in one working step.

It is also possible to omit the additional rectangular insulating portion. In this alternative embodiment, the size of the cover layer is adapted to the width of the legs so that it also completely covers the leg. In this embodiment the insulating strip is applied near one longitudinal edge of the cover layer. To fix the cover layer on the leg and to assure sufficient sealing of the hems the insulating strip may additionally comprise an adhesive layer.

According to a further (third) aspect of the invention the sealing strip comprises a cover layer and an insulating strip, whereas the insulating strip comprises three portions with different cross-sections. In one embodiment of this aspect the insulating strip shows three insulating portions whereas two insulating portions are of the shape and the third insulating portion is different in shape. The insulating portions with the same shape are arranged near the longitudinal edges of the cover layer, the outer portions, and the insulating portion with the different shape is arranged in between the outer portions. The outer portions preferably have a round, oval or triangular cross-section, and the portion in between preferably has a rectangular cross-section and is flatter than the outer portions and band-shaped. Also with this aspect the cover layer has side sections which extend beyond the insulating strip, in particular extend beyond the outer insulating portions of the insulating strip. The cross-sections of the outer insulating portion may be the same or different. With this, the insulating strip may comprise insulating portions with two or three different cross-sections.

All three insulating portions of the insulating strip can integrally be formed of the same material to from a single piece strip. As an alternative three insulating strips with different shapes, i.e., two with round, oval or triangular shape and one with a flat rectangular shape, can be applied on the cover layer next to each other in three working steps.

It is also possible to omit the additional rectangular insulating portion. In this alternative embodiment, the sealing strip comprises an adhesive layer instead of the additional rectangular insulating portion to better seal any gaps that may occur by installing two tracks in a row.

The sealing strip according to the third aspect of the invention is advantageous over the sealing strip according to the second aspect of the invention in that its overall cross-section is symmetric and therefore can be applied from opposite sides and with this the user can freely choose the application direction of the sealing strip. Furthermore, an enhanced sealing of the longitudinal edge of the leg of the track can be achieved with this aspect since outer portions of the sealing strip can better adapt to uneven areas of the legs. Another advantage over the sealing strip according to the second aspect is that during production of the sealing strip it is easier to roll up the sealing strip.

The above-described and other features, aspects and advantages of the present invention are described below with reference to drawings of preferred embodiments, which are intended to illustrate, but not to limit, the invention.

DETAILED DESCRIPTION OF THE DRAWINGS

Figure 1:
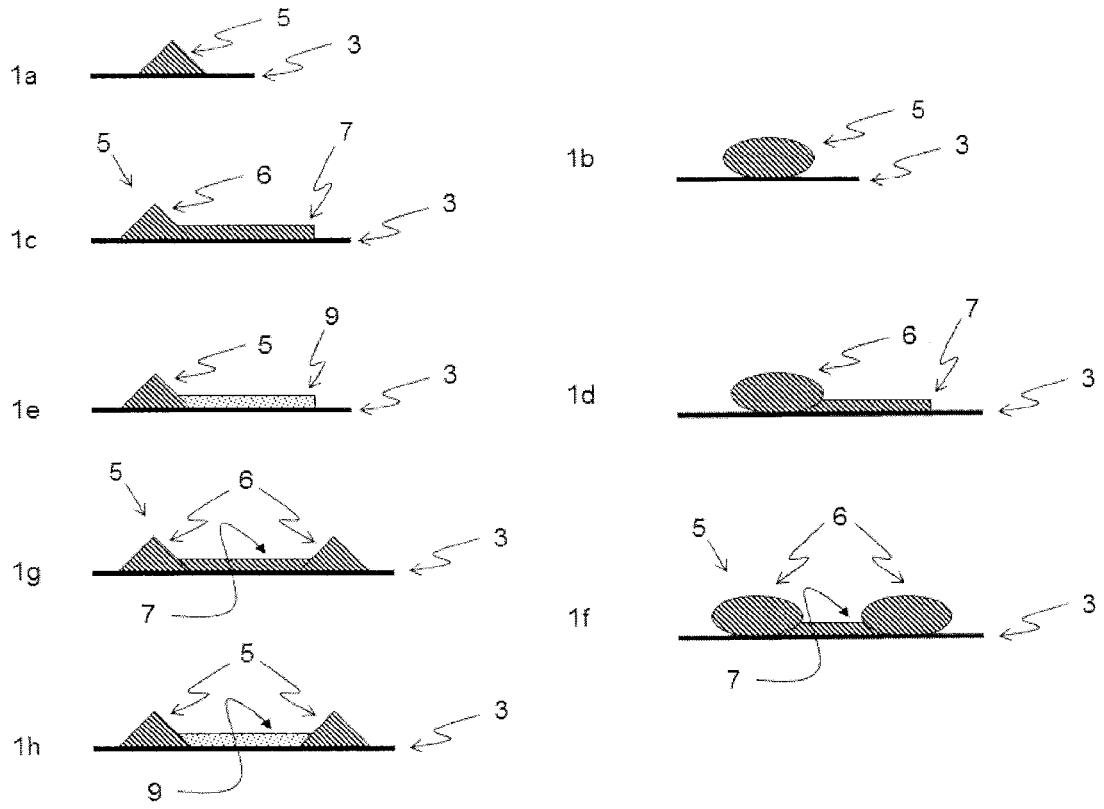
FIGS. 1*a* to 1*h* show various cross-sectional views of the sealing strip according to some embodiments of the invention.

FIGS. 1*a* to 1*f* illustrate various embodiments of the sealing strip 1 of the invention. In each embodiment shown the sealing strip 1 is design as an endless tape.

FIGS. 1*a* and 1*b* show two embodiments of the sealing strip 1 according to the first aspect of the invention. The sealing strip shown in these figures comprise a cover layer 3 and an insulating strip 5 of triangular shape as best seen in FIG. 1*a* or of oval shape as shown in FIG. 1*b*, the cover layer 3 having two side sections extending beyond the insulating strip 5. The insulating strip 5 is positioned in the middle of the cover layer 3.

FIGS. 1*c* to 1*e* show three embodiments of the sealing strip 1 according to the second aspect of the invention. The sealing strip shown in these figures comprise a cover layer 3 and an insulating strip 5. The insulating strip 5 has two portions of insulating material 6 and 7 whereas the portion 6 is either of triangular shape as shown in FIG. 1*c* or of oval shape as shown in FIG. 1*d* and the portion 7 is of rectangular shape and is less in height than the portion 6. Both portions are positioned next to each another. The cover layer 3 has two side sections extending beyond the insulating strip 5. FIG. 1*e* shows a further embodiment of the second aspect of the invention wherein the sealing strip 1 has an adhesive strip 9 instead of the insulation portion 7 of the embodiments shown in FIGS. 1*c* and 1*d*.

FIGS. 1*f* to 1*h* show three embodiments of the sealing strip 1 according to the third aspect of the invention. The sealing strips shown in these figures comprise a cover layer 3 and an insulating strip 5. The insulating strip 5 has three portions of insulating material 6 and 7 whereas the portions 6 are either of triangular shape as shown in FIG. 1*g* or of oval shape as shown in FIG. 1*f* and the portion 7 is of rectangular shape and is less in height than the portions 6. The portion 7 is positioned in between the portions 6 so that the insulating portions 6 constitute the outer portions. The cover layer 3 has two side sections extending beyond the insulating strip 5. FIG. 1*h* shows a further embodiment of the third aspect of the invention wherein the sealing strip 1 has an adhesive strip 9 instead of the insulation portion 7 of the embodiment shown in FIG. 1*g*.

Figure 2:
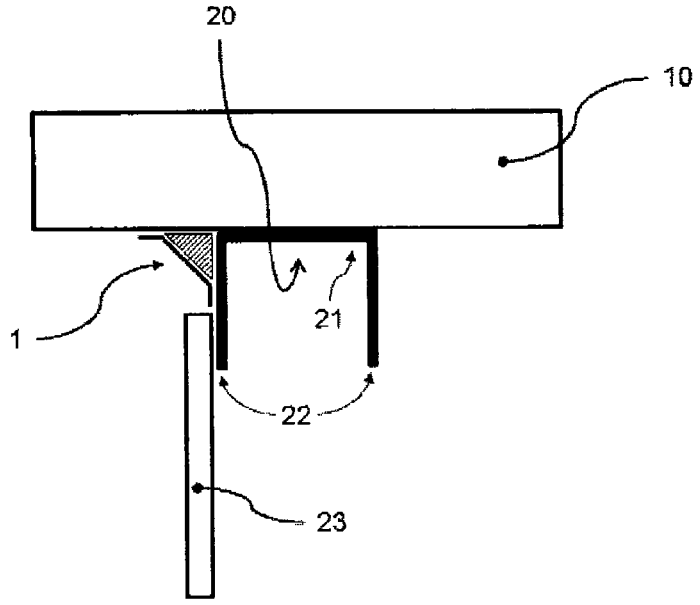
FIG. 2 is a cross-sectional view of a portion of a stud wall assembly with a sealing strip according to FIG. 1*a* installed at a head-of-wall joint according to one embodiment of the invention.

FIG. 2 illustrates one embodiment of the sealing strip 1 of the invention applied to a dry wall assembly. The dry wall assembly comprises a header track 20 with a web 21, legs 22, wallboards 23 and studs (not shown). The header track is a U-shaped channel that is attached to an upper horizontal support structure 10 (also referred to as ceiling 10). Wall studs (not shown) are received in the header track 20 and may be configured for vertical movement relative to the header track 20. A wallboard 23 is attached to the studs such as by a plurality of suitable fasteners.

Figure 3:
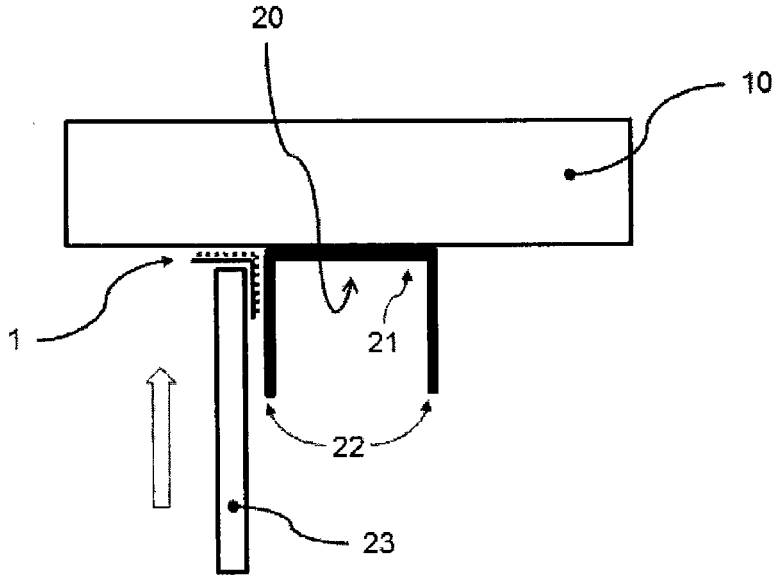
FIG. 3 is a cross-sectional view of the portion of the stud wall assembly according to FIG. 2 after upwards movement of the wallboard.

As shown in FIG. 2 a sealing strip 1 as shown in FIG. 1*a* or 1*b* is applied to the joint between the ceiling 10 and the track 20 by simply pressing the sealing strip 1 in the corner between ceiling and track whereas the specific design of the insulating strip, which is indicated by the triangular portion (see FIG. 1) makes the application easier and assures that enough material is placed before the joint. Due to the side portions the cover layer extends beyond the insulating strip and covers part of the ceiling 10 and the leg 22 of the track 20 where there is no insulating material. This assures that the wallboard 23 can freely move upwards and downwards due to deflection of the assembly and therefore supports movement of the wallboard 23. In case of upwards movement of the wallboard 23 the wallboard 23 will squeeze the insulating strip so that the insulating strip will be flattened as is shown in FIG. 3. As a result insulating material will be pushed in the area between the ceiling 10 and the cover layer and the area between the leg 22 and the cover layer. In this figure the squeezed insulating material is shown by the dotted line. The side portions of the cover or support layer now cover the squeezed insulating strip to avoid sticking of the insulating material on the wallboard 23 and to prevent the insulating strip 1 from being torn down when the wallboard 23 moves downwards.

Figure 4:
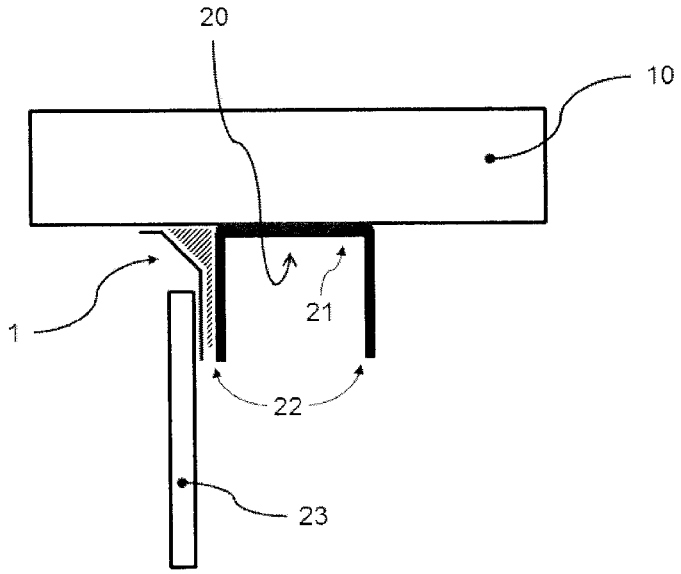
FIG. 4 shows a schematic sectional view of a portion of a stud wall assembly with a sealing strip according to FIG. 1*c* or 1*d* installed at the head-of-wall joint according to another embodiment of the invention.

One embodiment of the sealing strip 1 according to the second aspect of the present invention is shown in FIG. 4. A sealing strip 1 as shown in FIGS. 1*c* and 1*d* is applied to the joint between the ceiling 10 and the track 20 by simply pressing the sealing strip 1 in the corner between ceiling and track. The insulating portion 6 (see FIGS. 1*c* and 1*d*) is located just before the joint and the insulating portion 7 will cover the leg 22. Again, the side portions of the cover layer will extend beyond the insulating material to enable squeezing of the insulating strip 1 due to movement of the wallboard 23 as is described above for FIGS. 2 and 3.

Figure 5:
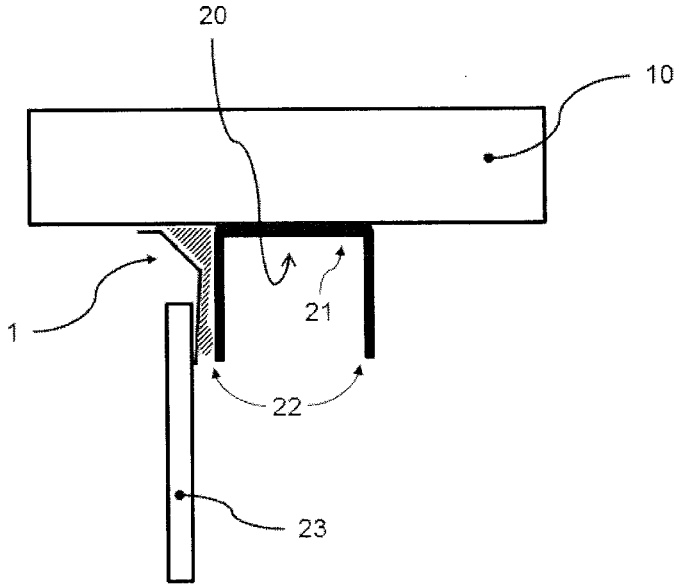
FIG. 5 is a cross-sectional view of a portion of a stud wall assembly with a sealing strip according to FIG. 1*g* or 1*f* installed at the head-of-wall joint according to another embodiment of the invention.

One embodiment of the sealing strip 1 according to the third aspect of the present invention is shown in FIG. 5. A sealing strip 1 as shown in FIGS. 1*f* and 1*g* is applied to the joint between the ceiling 10 and the track 20 by simply pressing the sealing strip 1 in the corner between ceiling and track. One insulating portion 6 (see FIGS. 1*f* and 1*g*) is located just before the joint and the insulating portion 7 or in alternative the adhesive portion 9 (see FIG. 1*h*) will cover the main portion of the leg 22. The further insulating portion 6 is position near the longitudinal edge of the leg to better adapt uneven areas. Again, the side portions of the cover layer will extend beyond the insulating material to enable squeezing of the insulating strip 1 due to movement of the wallboard 23 as is described above for FIGS. 2 and 3.

Figure 6:
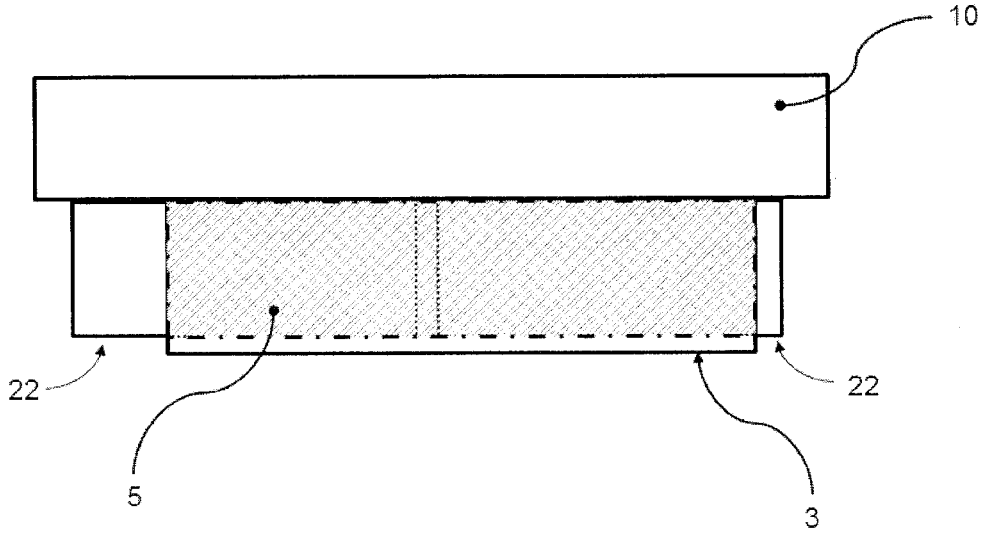
FIG. 6 is a schematic view cross-sectional view of a portion of a stud wall assembly with adjacent tracks and with a sealing strip according to FIG. 1 or installed at the head-of-wall joint according to one embodiment of the invention.
Figure 7:
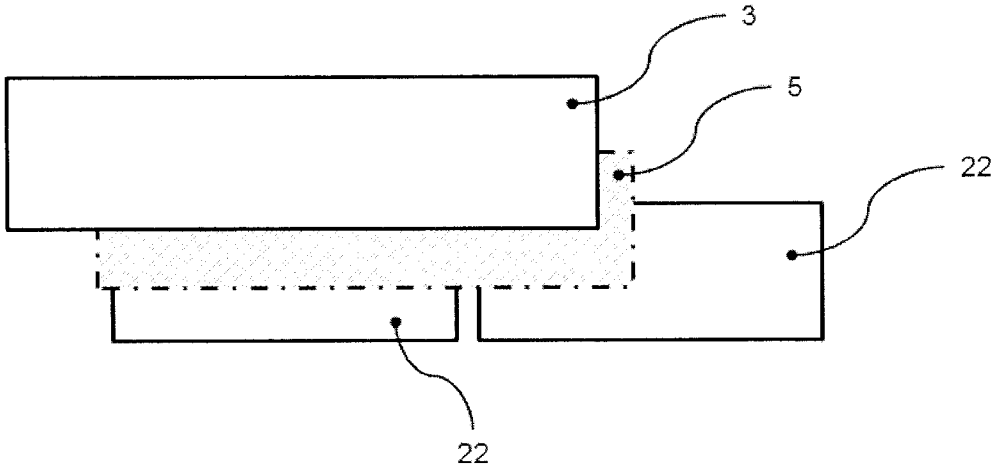
FIG. 7 is an exploded view of the stud wall assembly according to FIG. 6.

The embodiments shown in FIGS. 4 and 5 and in particular the embodiments of the second and third aspect of the invention (see FIGS. 1*d* to 1*h*) are configured to also seal gaps between two adjacent tracks when two or more tracks in a row are needed. As is shown in FIG. 6. FIG. 6 is a side view of the head-of-wall assembly shown in one of the FIG. 3 or 4. In this view two tracks 20 are fixed to the ceiling 10. The gap between the legs 22 is sealed by the insulating strip 5 which covers the legs completely. The cover layer 3 has side sections which extend beyond the insulating material to enable movement of the wallboard (not shown) and to avoid sticking of the insulating material on the wallboard to prevent the insulating strip 1 from being torn down. FIG. 7 is an exploded view of the configuration shown in FIG. 6 to better illustrate the structure of the configuration.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

The foregoing disclosure has been set forth merely to illustrate the invention and is not intended to be limiting. Since modifications of the disclosed embodiments incorporating the spirit and substance of the invention may occur to persons skilled in the art, the invention should be constructed to include everything within the scope of the appended claims and equivalents thereof.

What is claimed is:

1. A sealing element for sealing a gap or joint between a support structure and a track, wherein the track includes a web and legs that extend vertically from the web, comprising:

a cover layer; and an insulating strip disposed on the cover layer wherein the insulating strip includes a first portion with a first round, oval, or triangular cross-section, wherein the insulating strip includes a second portion with a second cross-section, and wherein a shape of the first cross-section of the first portion is different from a shape of the second cross-section of the second portion.

2. The sealing element according to claim 1, wherein the cover layer is an intumescent material.

3. The sealing element according to claim 1, wherein the cover layer includes metal wires.

4. The sealing element according to claim 1, wherein the insulating strip is an acoustical insulating material.

5. The sealing element according to claim 1, wherein the insulating strip is an intumescent material.

6. The sealing element according to claim 1, wherein the insulating strip contains an intumescent material and an acoustical insulating material.

7. The sealing element according to claim 1, wherein the second cross-section of the second portion has a rectangular shape.

8. The sealing element according to claim 1, further comprising a second insulating strip disposed on the cover layer, wherein the second insulating strip includes a portion with a cross-section and wherein the cross-section of the portion of the second insulating strip is different from the first cross-section of the first portion of the insulating strip.

9. The sealing element according to claim 8, wherein the cross-section of the portion of the second insulating strip has a rectangular shape.

10. The sealing element according to claim 1, wherein the insulating strip includes a third portion with a third cross-section.

11. The sealing element according to claim 10, wherein the first cross-section of the first portion and the third cross-section of the third portion have a same shape and wherein the second cross-section of the second portion has a different shape than the first cross-section of the first portion and the third cross-section of the third portion.

12. The sealing element according to claim 11, wherein the first portion and the third portion are disposed at respective longitudinal ends of the cover layer and wherein the second portion is disposed between the first portion and the third portion.

13. The sealing element according to claim 12, wherein the second cross-section of the second portion has a rectangular shape.

14. The sealing element according to claim 1, further comprising:

a second insulating strip disposed on the cover layer with a third portion with a third cross-section; and a third insulation strip disposed on the cover layer with a fourth portion with a fourth cross-section.

15. The sealing element according to claim 14, wherein the first cross-section of the first portion and the fourth cross-section of the fourth portion have a same shape and wherein the third cross-section of the third portion has a different shape than the first cross-section of the first portion and the fourth cross-section of the fourth portion.

16. The sealing element according to claim 15, wherein the first portion and the fourth portion are disposed at respective longitudinal ends of the cover layer and wherein the third portion is disposed between the first portion and the fourth portion.

17. The sealing element according to claim 16, wherein the third cross-section of the third portion has a rectangular shape.

18. The sealing element according to claim 1, further comprising an adhesive strip disposed on the cover layer, wherein a cross-section of the adhesive strip is different from the first cross-section of the first portion.

19. The sealing element according to claim 18, wherein the cross-section of the adhesive strip has a rectangular shape.

20. A sealing element for sealing a gap or joint between a support structure and a track, wherein the track includes a web and legs that extend vertically from the web, comprising:

a cover layer; and an insulating strip disposed on the cover layer, wherein the insulating strip includes a first portion with a first round, oval, or triangular cross-section, wherein the insulating strip includes a second portion with a second cross-section wherein a shape of the first cross-section of the first portion is different from a shape of the second cross-section of the second portion, and wherein the first portion of the insulating strip is disposed near a gap or joint between the support structure and a leg of the track.

* * * * *